US005507617A

United States Patent [19]

Sun

[11] Patent Number: 5,507,617

[45] Date of Patent: Apr. 16, 1996

[54] REGENERATIVE TURBINE PUMP HAVING LOW HORSEPOWER REQUIREMENTS UNDER VARIABLE FLOW CONTINUOUS OPERATION

[75] Inventor: Hongwei Sun, Naperville, Ill.

[73] Assignee: General Signal Corporation, Stamford, Conn.

[21] Appl. No.: 101,640

[22] Filed: Aug. 4, 1993

[51] Int. Cl.[6] ..... F04D 5/00

[52] U.S. Cl. ..... 415/55.1; 415/55.4; 29/889.23; 409/132; 409/198

[58] Field of Search ..... 415/55.1, 55.2, 415/55.3, 55.4, 55.5, 55.6, 55.7; 409/131, 132, 198; 29/889.21, 889.22, 889.23

[56] References Cited

U.S. PATENT DOCUMENTS

| | | | |
|---|---|---|---|
| 2,045,851 | 6/1936 | Hamilton | 415/55.4 |
| 2,220,538 | 11/1940 | Neibert | 415/55.4 |
| 2,671,404 | 3/1954 | Krueger | 415/55.7 |
| 4,770,574 | 9/1988 | Lotz | 409/132 |
| 5,163,810 | 11/1992 | Smith | 415/55.1 |

OTHER PUBLICATIONS

Yamazaki, Shinzo et al., "Reseaches on the Performance on the Regenerative Pump with Non–Radial Vanes." Bulletin of the Japanese Society of Mechanical Engineers, vol. 14, No. 77 (1971), pp. 1178–1186.

*Primary Examiner*—Edward K. Look
*Assistant Examiner*—Christopher Verdier
*Attorney, Agent, or Firm*—Milton E. Kleinman; Raymond E. Smiley; Robert S. Smith

[57] ABSTRACT

A regenerative turbine pump apparatus which includes a housing having an inlet and an outlet and a generally circular impeller having a circumference and a geometric axis. The impeller is mounted for rotation within the housing about the geometric axis and has first and second generally circular faces. At least the first generally circular face has a plurality of vanes extending from the circumference generally toward the geometric axis. Each of the vanes has generally planar mutually parallel side walls disposed in oblique relationship to a tangent to the impeller proximate to the intersection of the vane and the circumference. Adjacent vanes about the circumference each being separated by a slot extending from the circumference and extending to a substantially rectilinear line, the substantially rectilinear lines collectively define a plurality of steps around the impeller.

6 Claims, 4 Drawing Sheets

REGENERATIVE TURBINE PUMP HAVING LOW HORSEPOWER REQUIREMENTS UNDER VARIABLE FLOW CONTINUOUS OPERATION

BACKGROUND OF THE INVENTION

The invention relates to regenerative turbine pumps which are sometimes also referred to as turbine pumps, periphery pumps, turbulence pumps, or friction pumps. The turbine pump name has been used because (a) the impeller is rotated at high speed and (b) has a plurality of vanes, resembling those of a steam turbine, machined into the periphery of the impeller. Some such pumps have vanes on only one side of the impeller, although, the more common form has vanes on both sides of the impeller. Most, but not all, have radial vanes. Others have no-radial vanes. Some forms of regenerative turbine pumps may be multistage structures. Two stage regenerative turbine pumps direct a fluid from a first stage to a second stage. While the invention will be described in terms of the type having vanes on both sides of the impeller and a single stage pump it will be understood by those skilled in the art that the invention has application to other regenerative pump forms.

Regenerative turbine pumps will move a relatively low flow of fluid at a relatively high head. More specifically, such pumps have a relatively steep head capacity curve. The regenerative turbine pump has higher efficiencies at low flows than a centrifugal pump. A regenerative turbine type pump typically will produce several times the pressure produced by a centrifugal pump having an impeller of equal diameter and operating at the same speed.

Regenerative turbine pumps have many applications where high head and low flow are required. Typical applications include: boiler water feed systems, rocket booster systems, car wash applications, chemical feed systems, chlorine injection systems, condensate return systems, dry cleaning systems, electronic cooling systems, high pressure sprays, petroleum refining processes, TV tube/CRT manufacturing, as well as air conditioning, refrigeration, and heating applications.

The most important application of regenerative turbine pumps is for boiler feed systems. The addition of feed water to a boiler is handled by two general methods: intermittent (on-off) operation and continuous operation. In a continuous operation, the feed water is controlled by a modulating valve that regulates to keep a constant water level in a boiler. Depending on the flow requirement, the pump can operate at any point along its performance curve. During the operating cycle of a boiler it is normal for the boiler periodically become full so that there is no demand for more water. At such times a modulating valve will nearly close and the pump will flow only a very small amount of by-pass water.

A standard regenerative turbine impeller has radial vanes which have a uniform height. The advantages of this kind of impeller include a low manufacturing cost and a steep head capacity curve which provides stable operation at substantially fixed flow and pressure conditions. A disadvantage of the conventional impeller is that it is not suitable for continuous variable flow operation.

Unlike a centrifugal pump, a regenerative turbine pump has an increasing horsepower requirement with decreasing flow. Accordingly, the horsepower consumption near shut-off conditions is much higher than that at the best efficiency point. The steeper the head capacity curve, the larger the horsepower variation at different flows. For continuous operation applications, the motor size is chosen based on the power consumption at the smallest operating flow. Thus, from the view point of saving energy as well as using motors with smaller horsepower, flat head-capacity curves are preferred for regenerative turbine pumps used in variable flow applications. Therefore, standard impellers with steep head-capacity curves are not suitable for continuous operation.

It is an object of the invention to provide a construction that will require less power to operate at variable flow conditions.

It is an object of the invention to provide such apparatus having a relatively flat head capacity curve.

It is another object of the invention to provide an apparatus having a novel impeller.

Still another object of the invention is to provide apparatus that will be inexpensive to manufacture.

SUMMARY OF THE INVENTION

It has now been found that these and other objects of the invention may be attained in a regenerative turbine pump an apparatus which includes a housing having an inlet and an outlet and a generally circular impeller having a circumference and a geometric axis. The impeller is mounted for rotation within the housing about the geometric axis and has first and second generally circular faces. At least the first generally circular face has a plurality of vanes extending from the circumference generally toward the geometric axis and each of the vanes has generally planar mutually parallel side walls disposed in oblique relationship to a tangent to the impeller proximate to the intersection of the vane and the circumference. Adjacent vanes about the circumference are each separated by a slot extending from the circumference and extending to a substantially rectilinear line. The substantially rectilinear lines collectively define a plurality of steps around the impeller. A channel ring is disposed around the impeller.

In some forms of the invention the second generally circular face has a plurality of vanes extending from the circumference generally toward the geometric axis and each of the vanes having generally planar mutually parallel side walls disposed in oblique relationship to a tangent to the impeller proximate to the intersection of the vane and the circumference. Adjacent vanes about the circumference are each separated by a slot extending from the circumference and extending to a substantially rectilinear line, The substantially rectilinear lines collectively define a plurality of steps around the impeller. In some forms of the invention the channel ring disposed around the impeller has a cross-section substantially in the form of an oval.

In some forms of the invention the regenerative turbine pump apparatus includes a housing have an inlet and an outlet and a generally circular impeller having a circumference and having a geometric axis. The impeller is mounted for rotation within the housing about the geometric axis thereof. The impeller has first and second generally circular, generally planar faces. At least the first generally circular face has a plurality of vanes extending from the circumference generally toward the geometric axis of the impeller. Each of the vanes has generally planar mutually parallel side walls disposed in oblique relationship to a tangent to the impeller proximate to the intersection of the respective vane and the circumference. Adjacent vanes about the circumference are each separated by a slot extending from the circumference and extending to a substantially rectilinear line. The slots are machined into the impeller by a process which includes sequentially advancing a milling cutter, rotating on an axis which at all times is in a first plane parallel to the first face, to cut one side of a slot in the impeller and then withdrawing the milling cutter, indexing the impeller by rotating the impeller on the axis thereof and again advancing the milling cutter, rotating on an axis which at all times is in said first plane parallel to the first face, to cut another side of a slot in the impeller and then withdrawing the milling cutter, the axis of the milling cutter being at all times in said first plane parallel to the first side of the impeller.

BRIEF DESCRIPTION OF THE DRAWINGS

The invention will be better understood by reference to the accompanying drawing in which.

DESCRIPTION OF THE PREFERRED EMBODIMENT

Figure 1:
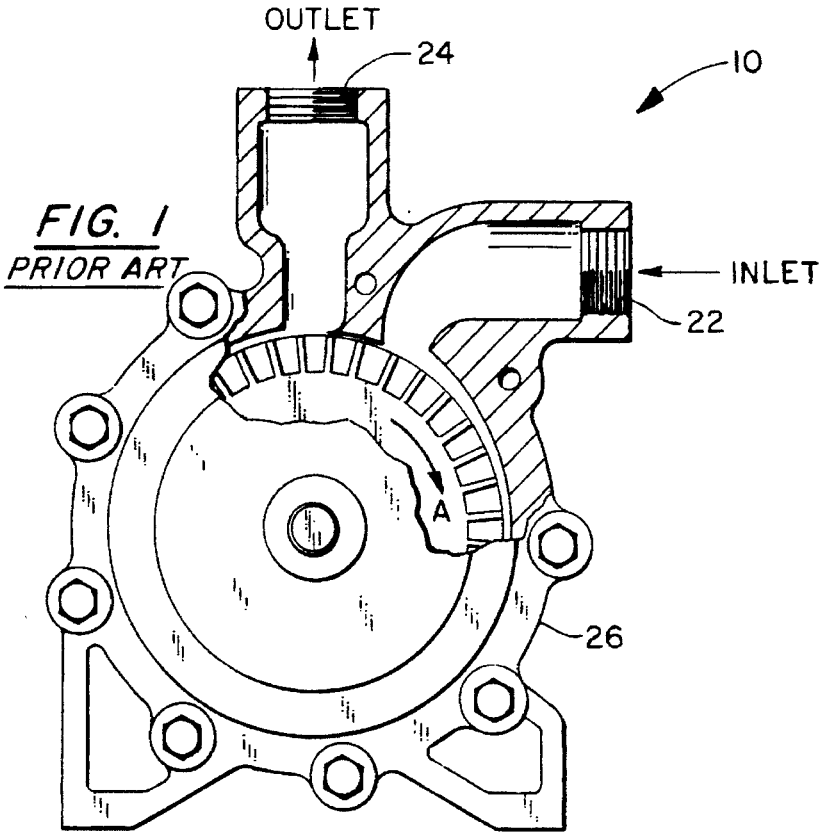
FIG. 1 PRIOR ART
FIG. 1 is a side elevational view in partial section of a regenerative turbine pump in accordance with one form of the invention.
Figure 2:
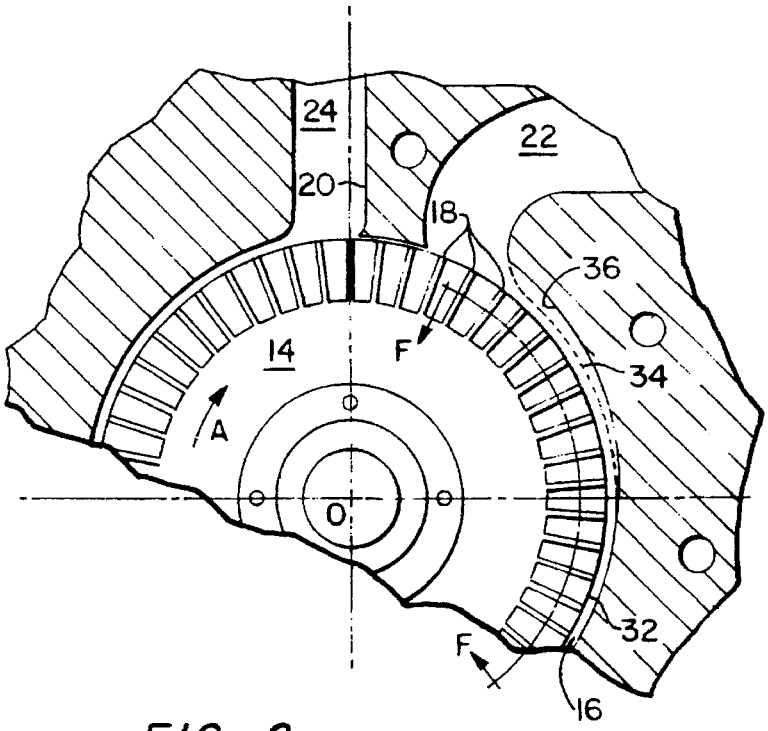
FIG. 2 PRIOR ART
FIG. 2 is a fragmentary sectional view to a larger scale of a portion of the pump shown in FIG. 1.
Figure 3:
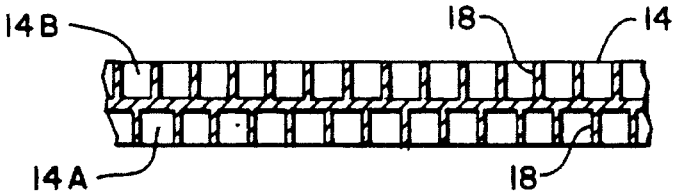
FIG. 3 PRIOR ART
FIG. 3 is a sectional view taken along the line F—F of FIG. 2.

Referring now to FIGS. 1–3 there is shown a conventional regenerative turbine pump 10 that has a conventional impeller 14 having radial vanes 18. The pump 10 is shown in partial section in the region of the inlet 22 and outlet 24 of a pump housing 26. The direction of rotation of the impeller 14 is indicated by an arrow A. The inlet/outlet region of the pump 10 is shown in greater detail in FIG. 2 which illustrates the impeller 14 disposed in a channel or channel ring 16 which is a part of the housing 26.

The impeller 14 has parallel sides 14A, 14B and includes a plurality of vanes 18 that disposed on both sides of the impeller 14 as best seen in FIGS. 3–8. The vanes 18 are offset from one axial side of the impeller 14 to the other as best seen in FIG. 3. The vanes are uniformly spaced around the impeller 14. The channel ring 16 is machined into the housing 26 which is cast as two axial sections. Those skilled in the art will recognize that the channel ring 16 is partly in one axial section of the housing 26 and partly in another axial section of the housing 26.

In U.S. Pat. No. 5,215,429 entitled *Improved Regenerative Turbine Pump* and having the same inventor and assignee as the present invention there is disclosed a channel ring 16 having increased side and radial clearance with respect the impeller 14 in an angular quadrant or arcuate portion near the inlet 22. Such structure is shown in FIG. 2. Those skilled in the art will understand that the specific channel ring 16 contours may be either that shown in FIG. 2 or a more uniform clearance throughout the angular extent of the impeller 14.

In the single stage regenerative turbine pump in accordance with one form of the invention the fluid enters through the inlet 22 and passes into the channel 16 on both sides of the impeller 14 adjacent to a first circumferential part of the impeller 14. The vanes 18 carry the fluid within the channel 16 for almost a full revolution of the impeller 14. A blocker or splitter 20 directs the fluid through an outlet 24. Ordinarily the splitter 20 is disposed much closer to the impeller 14 than the channel ring 16. This is necessary to separate the inlet 22 fluid stream from the outlet 24 fluid stream.

Figure 7:
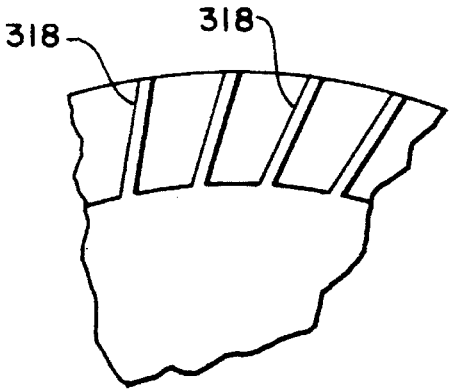
FIG. 7 PRIOR ART
FIG. 7 is a more detailed fragmentary side elevational view of a the prior art impeller having non-radial vanes illustrated in FIG. 6.
Figure 10:
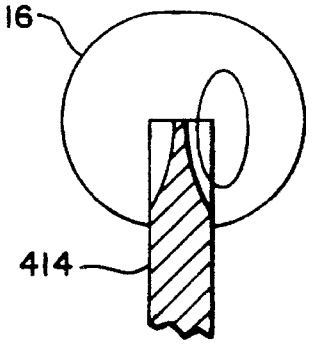
FIG. 10 is a diagrammatic view illustrating the flow channel surrounding the impeller in the preferred embodiment.
Figure 5:
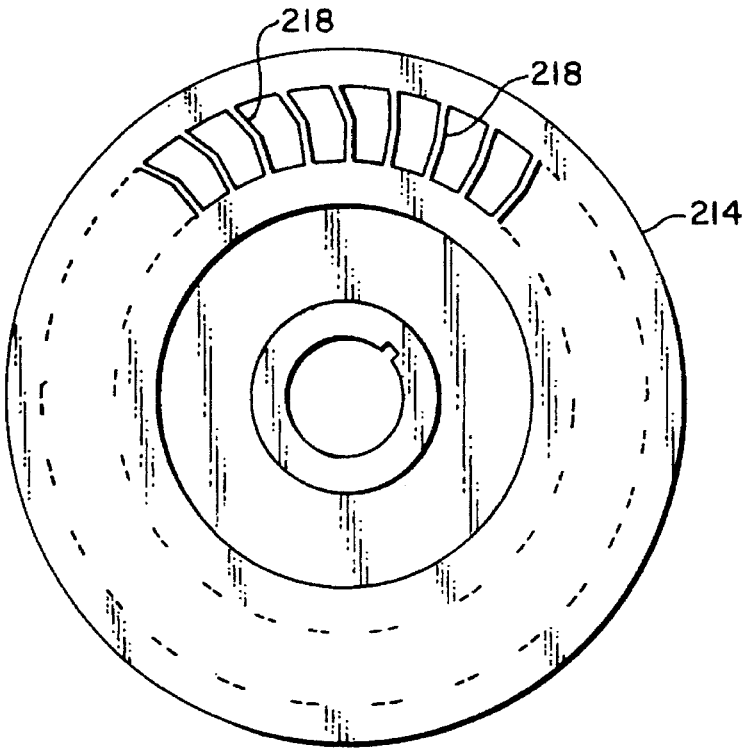
FIG. 5 PRIOR ART
FIG. 5 is a side elevational view of a prior art impeller having inclined vanes.
Figure 6:
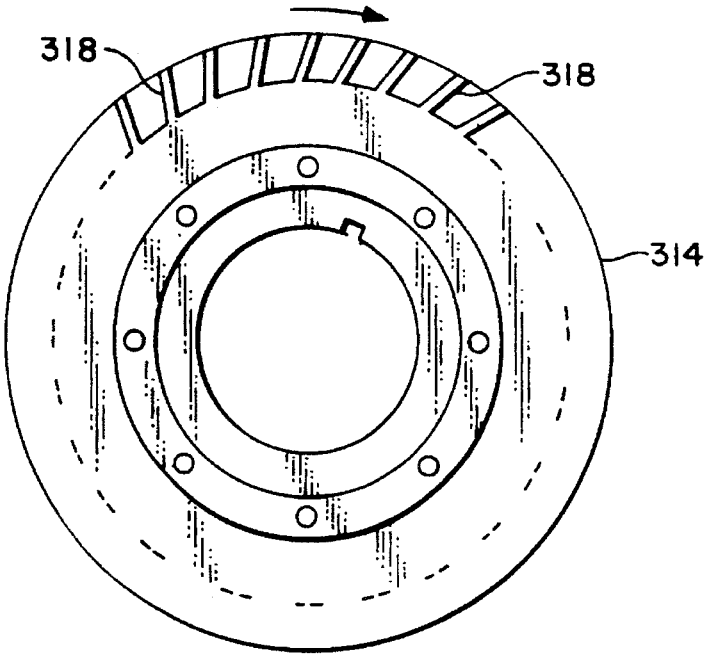
FIG. 6 PRIOR ART
FIG. 6 is a side elevational view of a prior art impeller having non-radial vanes.

The invention will be most easily understood by comparison to know prior art. It is known that a more steep performance curve slope can be obtained by using an inclined-vane impeller 214 such as that shown in FIG. 5. A performance curve having a less steep slope is obtained with the form of non-radial vane impeller 314 shown in FIGS. 6 and 7. However, the manufacturing cost of the inched-vane impeller shown in FIG. 5 and the non-radial vane impeller shown in FIGS. 6–7 is very high. The inclined-vane impeller 214 of FIG. 6 is particularly difficult to manufacture. The non-radial vane impeller 314 show in FIGS. 6 and 7 must be manufactured with special tooling. More particularly, the machining of the root of the vanes 318 is very difficult even with special tooling. A fragmentary portion of the impeller 314 is shown in FIG. 7 which shows the structure illustrated and described in an article entitled *Researches on the Performance of the Regenerative Pump with Non-Radial Vanes* by Shinzo Yamazaki and Uukio Tomita published in Volume 14, #77 (1971) issue of the Bulletin of the Japan Society of Mechanical Engineers. Another problem of the construction shown in this document is the low efficiency of the impeller.

The difficulty of machining the vanes 318 of the impeller 314 arises because the respective roots to the individual vanes 318 coincide with a circle (not shown). More particularly, as best seen in FIG. 7 even the "root" of each of the respective spaces intermediate adjacent vanes 318 coincide with the same circle.

Figure 4:
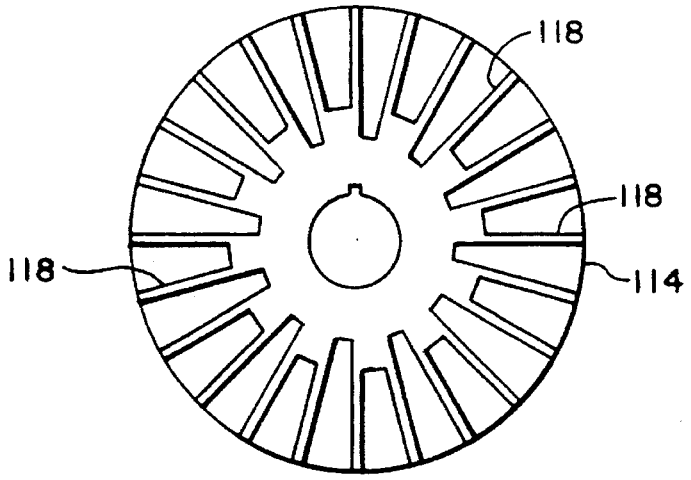
FIG. 4 PRIOR ART
FIG. 4 is a side elevational view of a prior art impeller having vanes which alternate in length.

A prior art impeller 114 having vanes that alternate in length is shown in FIG. 4. (It will be seen that the expression "vanes that alternate in length" refers to vanes that have opposed sides that are of different length and adjacent opposed sides of vanes are of equal length.) This type of impeller 114 is intended to and does provide greater efficiency than the impellers 214 and 314 shown respectively in FIGS. 5 and 6. The impeller 114, however, produces a steep head-capacity curve and is, accordingly, not good for continuous running operation. Another drawback of the impeller 114 is the difficulty of machining the vanes 118 which alternate in length.

Figure 8:
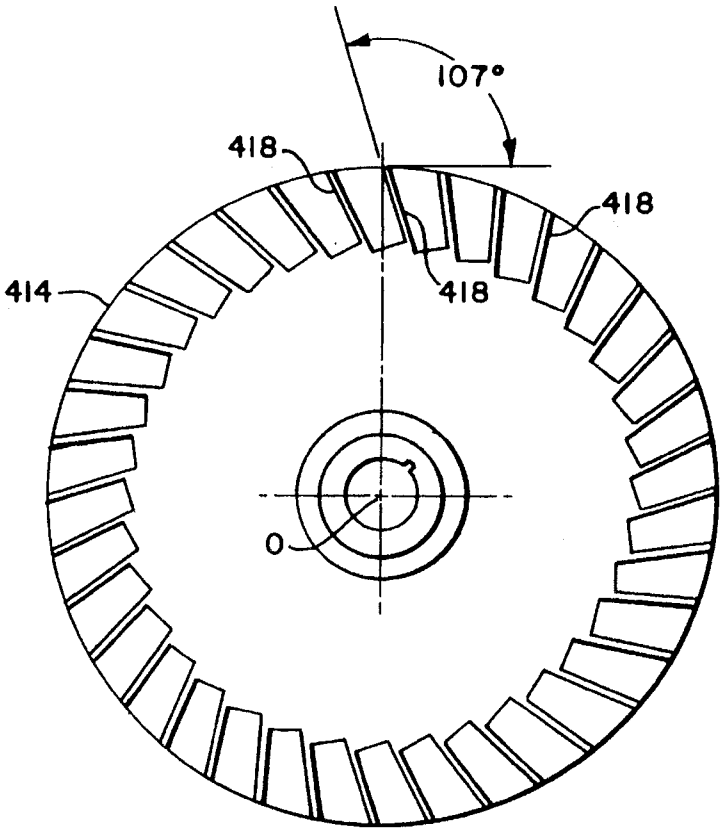
FIG. 8 is a partly schematic view of the non-radial vane impeller construction in accordance with the invention.

The present invention provides a regenerative turbine pump having a novel impeller 414 which combines the advantages of various conventional impellers. The impeller 414 of the present invention is shown in FIG. 8 and diagrammatically represented in FIG. 9. The impeller 414 has been found to be particularly satisfactory for continuous operation because it provides fiat head-capacity curve and, thus, has very small horsepower change at different flows. It also has good efficiency because of the special design at the root of the vanes 418 to be described hereafter. Although each vane 418 has same length, it produces a similar effect to that of the impeller 114 having vanes 11 8 which alternate in length. An additional advantage is that the structure may be easily machined.

The impeller 414 has a plurality of vanes 418 that each have mutually parallel sides such that the sectional view in FIG. 3 of the impeller 14 is identical for the impeller 414. Thus, in the preferred embodiment the vanes 418 are disposed on both sides of the impeller 414. The vanes 418 are offset from one axial side of the impeller 414 in the same manner shown in FIG. 3 and the vanes 418 are also uniformly spaced around the impeller 414.

The construction of the impeller 414 may best be described by the process by which the impeller 414 is manufactured. In the preferred form of the invention the sides of each individual vane are mutually parallel. In the illustrated embodiment the respective sides of each vane are disposed at an angle of 107 degrees with respect to a tangent to a radius extending through the outermost portion of the respective wall. In other forms of the invention the angle is between 92 and 140 degrees with respect to the tangent to a radius. The angle selected will depend on the desired slope of the performance curve. More specifically, the larger the angle the flatter the performance curve will be. Those skilled in the art will recognize that radial vanes typically have walls disposed at 90 degrees with respect to a tangent to a radius extending through the outermost portion of the respective wall.

Figure 9:
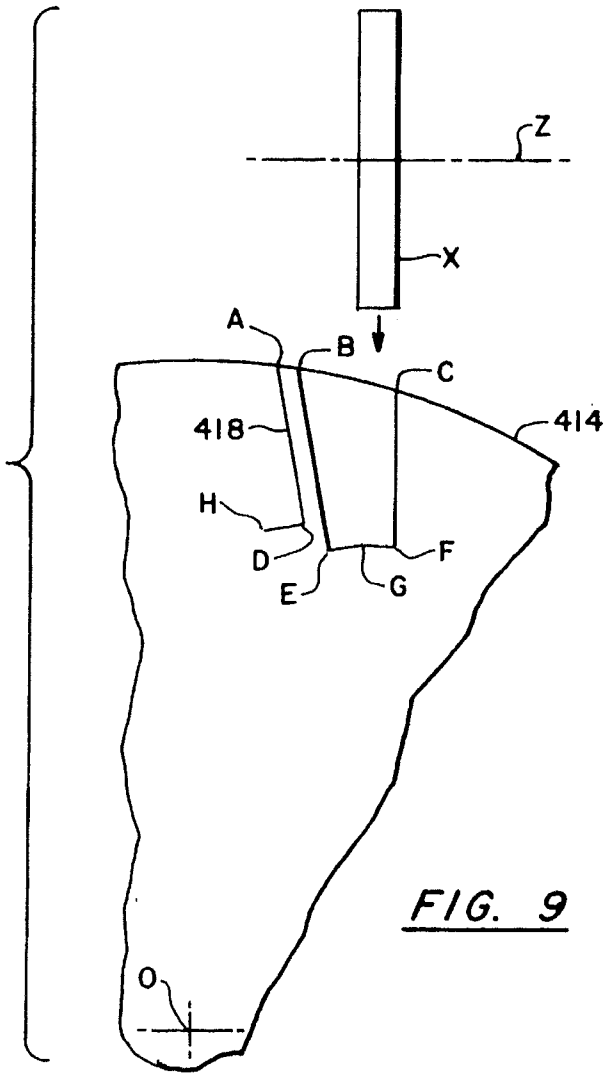
FIG. 9 is a diagrammatic view representing a portion of the periphery of the impeller shown in FIG. 8.

Referring now particularly to FIG. 9, the opposed planar side walls of two adjacent vanes 418 are represented by the lines BE and CF. The line BE representing one planar side wall of one of the vanes is parallel to the other planar side wall, of the same vane, represented by the line AD. The lines BE and CF are not parallel. More particularly, the distance between B and C is greater than the distance between E and F.

The vanes 418 are machined in the first and second opposed parallel faces of a cylindrical section shaped blank by a milling cutter X. The cutter X is mounted on a shaft having an axis Z. The milling cutter X is advanced in the general direction of the geometric center O of the cylindrical section in which the vanes will be cut. The cylindrical section shaped blank is maintained stationary during each cutting operation. For the sake of simplicity the planar face of the cylindrical section will be assumed to be horizontal during all cuffing operations. Thus, the axis of the cylindrical section will be vertical. The axis of the milling cutter will be horizontal and will move through a plurality of positions that are in a horizontal plane that is parallel to the planar face of the cylindrical section in which the vane is being cut. The first cut will define the wall CF and the portion of the root defined by the line GF. The wall CF is perpendicular to portion to the root defined by the line GF. It will be understood that the right side (as viewed) of the milling cutter X will define the wall CF.

Thereafter, the cylindrical section will be rotated about the vertical axis O and the milling cutter X will again be advanced in the general direction of the geometric center O of the cylindrical section in which the vanes are being cut. The cylindrical section will be maintained stationary during the cutting operation. The planar face of the cylindrical section will again be horizontal during the cutting operation. Thus, the axis of the cylindrical section will again be vertical. The axis of the milling cutter will be horizontal and will move through a plurality of positions that are in a horizontal plane that is parallel to the planar face of the cylindrical section in which the vane is being cut. The second cut will define the wall BE and the portion of the root defined by the line EG. The wall BE is perpendicular to the portion of the root defined by the line EG. It will be understood that the left side (as viewed) of the milling cutter X will define the wall BE.

Those skilled in the art will recognize that the portion of the root defined by the lines EG and the portion of the root defined by the line GF are each straight line segments. Because the two line segments are not perfectly aligned it will be understood that they do not collectively exactly define a rectilinear line. However, it will also be clear that the line segments collectively are "substantially" a rectilinear line segment. More particularly, visual observation of the actual part does not suggest that the EGF is anything other than a rectilinear line.

Thereafter, the cylindrical section will be rotated further about the vertical axis O and the milling cutter X will again be advanced in the general direction of the geometric center O of the cylindrical section in which the vanes are being cut. The cylindrical section will still be maintained stationary during the cutting operation. The planar face of the cylindrical section will again be horizontal during the cutting operation. Thus, the axis of the cylindrical section will again be vertical. The axis of the milling cutter will be horizontal and will move through a plurality of positions that are in a horizontal plane that is parallel to the planar face of the cylindrical section in which the vane is being cut. The third cut will define the wall AD and the portion of the root defined by the line DH. It will be understood that the right side (as viewed) of the milling cutter X will define the wall DH. The wall AD is perpendicular to portion to the root defined by the line HD. The wall AD is parallel to the wall BE.

In this manner the entire periphery of each of the two opposed planar faces of the cylindrical section are machined to define equally spaced vanes. A distinctive aspect of the impeller 414 is the step shape of the successive (adjacent) vanes 418. It will be seen the distance from the periphery of the impeller to the root will be different on different sides of the same vane. Thus, side AD is shorter than side BE.

The impeller 418 in accordance with the invention may be manufactured without the need for a special milling cutter. The milling cutter may be positioned with the axis at a fixed or constant angle with respect to a radial direction on the cylindrical section in which the vanes are being cut. A substantial amount of testing on pumps incorporating the impellers 414 has established that the horsepower requirements at shutoff are reduced to approximately half compared to the horsepower requirements with conventional impellers.

It is preferable for some applications that the flow channel 16 around the impeller 414 have a generally oval shaped cross-section rather than a the more common square or rectangular, rectangular with cutoff corners, or circular cross-section channel. It has been found that for some application the oval flow channel fits the flow stream better and provide less pressure drop. Therefore, for those particular applications the oval flow channel provides higher head and better efficiency than rectangular channels.

The invention has been described with reference to its illustrated preferred embodiment. Persons skilled in the art of such devices may upon exposure to the teachings herein, conceive other variations. Although the impeller has been described in terms of a milling process for manufacturing, it will be understood that the impeller may be made of other materials, such as plastic and may be molded. Other manufacturing techniques, such as powder metallurgy may also be used. Such variations are deemed to be encompassed by the disclosure, the invention being delimited only by the following claims.

I claim:

1. A regenerative turbine pump apparatus which comprises:

a housing having an inlet and an outlet;

a generally circular impeller having a circumference and having a geometric axis, said impeller being mounted for rotation within said housing about said geometric axis, said impeller having first and second generally circular faces, at least said first generally circular face having a first plurality of vanes extending from said circumference generally toward said geometric axis, each of said vanes having generally planar mutually parallel side walls disposed in oblique relationship to a tangent to said impeller proximate to the intersection of said vane and said circumference, adjacent vanes about said circumference in said first plurality of vanes each being separated by a slot extending from said circumference and extending to a substantially rectilinear line, said substantially rectilinear lines collectively defining a plurality of steps around said impeller; and a channel ring disposed around said impeller.

2. The apparatus as described in claim 1 wherein:

said second generally circular face has a second plurality of vanes extending from said circumference generally toward said geometric axis, each of said vanes having generally planar mutually parallel side walls disposed in oblique relationship to a tangent to said impeller proximate to the intersection of said vane and said circumference, adjacent vanes about said circumference in said second plurality of vanes each being separated by a slot extending from said circumference and extending to a substantially rectilinear line, said substantially rectilinear lines collectively defining a plurality of steps around said impeller.

3. The apparatus as described in claim 2 wherein:

said channel ring disposed around said impeller has a cross-section substantially in the form of an oval.

4. A regenerative turbine pump apparatus which comprises:

a housing having an inlet and an outlet;

a generally circular impeller having a circumference and having a geometric axis, said impeller being mounted for rotation within said housing about said geometric axis, said impeller having first and second generally circular, generally planar faces, at least said first generally circular face having a first plurality of vanes extending from said circumference generally toward said geometric axis, each of said vanes having generally planar mutually parallel side walls disposed in oblique relationship to a tangent to said impeller proximate to the intersection of said vane and said circumference, adjacent vanes about said circumference in said first plurality of vanes each being separated by a slot extending from said circumference and extending to a substantially rectilinear line, said slots being machined into said impeller by a process which includes sequentially advancing a milling cutter, rotating on an axis which at all times is in a first plane parallel to said first face, to cut one side of a slot in said impeller and then withdrawing said milling cutter, indexing said impeller by rotating said impeller on the axis thereof and again advancing said milling cutter, rotating on an axis which at all times is in said first plane parallel to said first face, to cut another side of a slot in said impeller and then withdrawing said milling cutter.

5. The apparatus as described in claim 4 wherein:

said second generally circular face has a second plurality of vanes extending from said circumference generally toward said geometric axis, each of said vanes having generally planar mutually parallel side walls disposed in oblique relationship to a tangent to said impeller proximate to the intersection of said vane and said circumference, adjacent vanes about said circumference in said second plurality of vanes each being separated by a slot extending from said circumference and extending to a substantially rectilinear line, said substantially rectilinear lines collectively defining a plurality of steps around said impeller.

6. The apparatus as described in claim 4 wherein:

said channel ring disposed around said impeller has a cross-section substantially in the form of an oval.

* * * * *